US006102744A

United States Patent [19]

Korsunsky et al.

[11] Patent Number: 6,102,744

[45] Date of Patent: Aug. 15, 2000

[54] CARD EDGE CONNECTOR AND CONTACT

[75] Inventors: Iosif Korsunsky, Harrisburg; Richard Schroepfer, Thompsontown, both of Pa.

[73] Assignee: The Whitaker Corporation, Wilmington, Del.

[21] Appl. No.: 09/085,451

[22] Filed: May 27, 1998

Related U.S. Application Data

[60] Provisional application No. 60/051,019, May 27, 1997.

[51] Int. Cl.[7] ..... H01R 24/00

[52] U.S. Cl. ..... 439/637

[58] Field of Search ..... 439/638, 637, 439/682

[56] References Cited

U.S. PATENT DOCUMENTS

| | | | |
|---|---|---|---|
| 3,654,592 | 4/1972 | Primorac . | |
| 3,659,243 | 4/1972 | Gluntz . | |
| 3,681,743 | 8/1972 | Townsend . | |
| 3,696,323 | 10/1972 | Kinkaid et al. . | |
| 4,080,032 | 3/1978 | Cherian et al. . | |
| 4,354,718 | 10/1982 | Bright et al. . | |
| 4,695,111 | 9/1987 | Grabbe et al. | 439/266 |
| 5,082,459 | 1/1992 | Billman et al. | 439/637 |
| 5,207,598 | 5/1993 | Yamada et al. | 439/636 |
| 5,286,215 | 2/1994 | Dewey et al. | 439/188 |
| 5,360,346 | 11/1994 | Regnier | 439/61 |
| 5,411,408 | 5/1995 | DiViesti et al. | 439/326 |
| 5,425,658 | 6/1995 | White | 439/637 |
| 5,462,496 | 10/1995 | Dick et al. . | |
| 5,511,985 | 4/1996 | Noschese et al. | 439/157 |
| 5,609,502 | 3/1997 | Thuma | 439/747 |
| 5,775,950 | 7/1998 | Tsuji | 439/637 |

FOREIGN PATENT DOCUMENTS

| | | |
|---|---|---|
| 1590005 | 5/1970 | Germany . |
| 60-205977 | 10/1917 | Japan . |
| 1171622 | 11/1969 | United Kingdom . |

*Primary Examiner*—Lincoln Donovan
*Assistant Examiner*—Javaid Nasri

[57] ABSTRACT

An electrical connector 12 is provided for receiving a card edge into a card-receiving slot 13. A series of contacts 20 are disposed inside contact-receiving cavities 14 which are provided along the card-receiving slot 13. The contacts 20 have a cantilever arm 42, a tail section 40 and a contact section 48 which is lanced from the cantilever arm 42. The contact section 48 is profiled to have a contact point 50 located at a distance from the cantilever arm 42 near a free end 44.

8 Claims, 3 Drawing Sheets

CARD EDGE CONNECTOR AND CONTACT

This application claims benefits of Provisional Application Ser. No. 60/051,019, filed May 27, 1997.

FIELD OF THE INVENTION

This invention is related to electrical connectors and more particularly to an electrical connector for establishing connections to an edge of a printed circuit board.

BACKGROUND OF THE INVENTION

As electrical circuits continue to develop in the computer industry, there is an increasing need for the separation of such circuitry so that some circuits reside on a mother board and others reside on daughter cards of various sizes. Daughter cards typically take the form of single in-line memory modules (SIMMs) or dual in-line memory modules (DIMMs). These modules typically contain memory to be utilized as RAM by the microprocessor which may be located on the mother board. The use of daughter cards, however, are not limited to the application of additional memory to be utilized as RAM. Some daughter cards also contain microprocessors of their own to perform various functions such as print acceleration, graphics enhancements or other desired mathematical operations. The movement in the industry towards the use of these daughter cards or modules has precipitated a need for electrical connectors suitable for establishing electrical connections between mother boards and the daughter cards.

Depending upon the architecture and circuit layout of the daughter card, these electrical connectors take various forms. For example, some require electrical connections to only one side of the card edge. Others require redundant electrical connections on both sides of the card edge in order to minimize failures. Finally, some applications require separate and distinct electrical connections along both sides of the board in order to maximize the use of available surface area to achieve a greater number of input/output (I/O) contact points.

An example of a DIMM connector is shown in the cross sectional view of FIG. 1. This connector features an insulative housing 1, a plurality of cavities 2 for receiving a pair of contacts 3. The contacts 3 each have a contact point 6 which is inside a card-receiving slot 7 and a tail section 8 which extends through the bottom surface 4 of the housing 1. These contacts 3 are insertable into the housing from the bottom surface 4. It should be noted that these contacts have a series of bends in order to locate the contact point 6 at a desired position for mating with pads on the edge of an inserted card. It should also be noted that the contact point 6 is located at a distance, D, away from the fulcrum point 5 so that the contacts 3 will pivot away from each other upon card insertion. This causes the contact points 6 to move along an arcuate path as they spread apart from each other. If this motion is analyzed in detail, it is apparent that the arcuate motion contains a vertical force component which is parallel to the card-receiving slot 7 and a horizontal force component which is perpendicular to the card-receiving slot 7. Accordingly, the resultant contact force on the card edge will have vertical and horizontal components. It is desirable to maximize the horizontal force component which is normal to the contact pads in order to establish more reliable electrical connections between the contacts 3 and the pads of the card edge.

One approach to increasing the reliability of these connection is shown in U.S. Pat. No. 5,207,598. This patent teaches a connector for a card edge having a plurality of contact terminals. Each terminal has a generally U-shaped contact portion which extends transverse through a contact cavity slot. The contact portion is horizontally cantilevered from a vertical cantilevered positioning portion. The U-shaped contact portion provides redundant contacts at both sides of the card edge. A problem exists with this design in that it does not utilize both sides of the card edge in order to maximize the number of I/O connections. An additional problem exists in that excess material is required to form the U-shaped portion in order to reach both sides of the card edge.

SUMMARY OF THE INVENTION

It is therefore an object of the present invention to provide a contact system which maximizes the horizontal component of deflection while minimizing the vertical component of deflection. It is a further object of the present invention to prevent stubbing of the electrical contacts upon card insertion.

It is a further object to minimize the amount of material necessary in order to form such a contact.

These and other objects have been achieved by providing a contact for use in a card-edge connector. The contact has a solder tail, a mounting section for securing the contact to a housing, a cantilever arm extending from the mounting section to a free end, and a contact portion near the free end of the cantilever arm. The contact portion is lanced from the cantilever arm such that it remains attached to the cantilever arm near the free end and provides a lead-in surface to prevent stubbing as a card edge is inserted.

BRIEF DESCRIPTION OF THE DRAWINGS

The invention will now be described by way of example with reference to the accompanying figures of which.

DETAILED DESCRIPTION OF THE EMBODIMENTS

Figure 1:
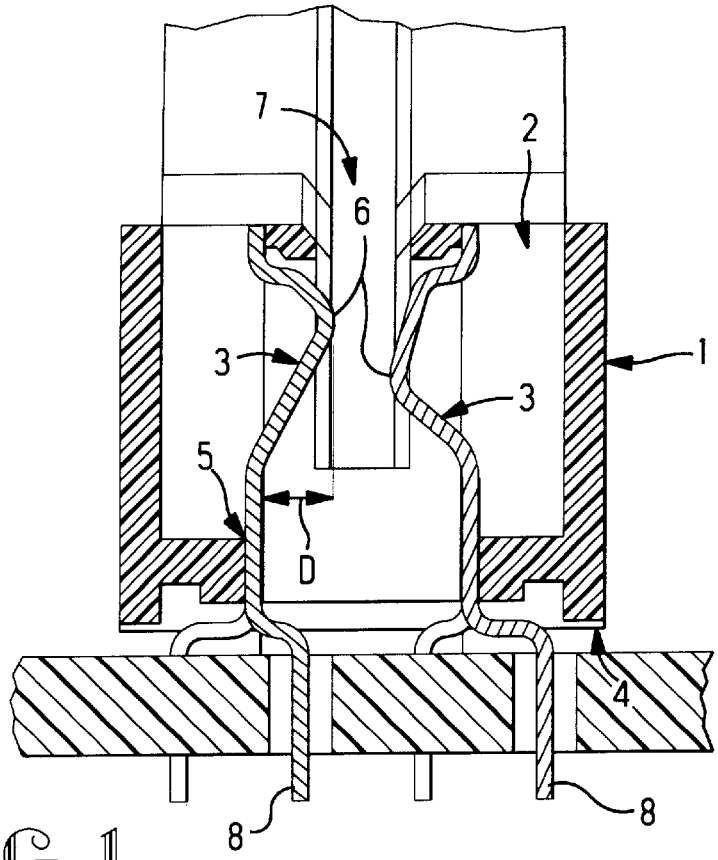
FIG. 1 Prior Art
FIG. 1 shows a cross sectional view of a known DIMM connector.
Figure 2:
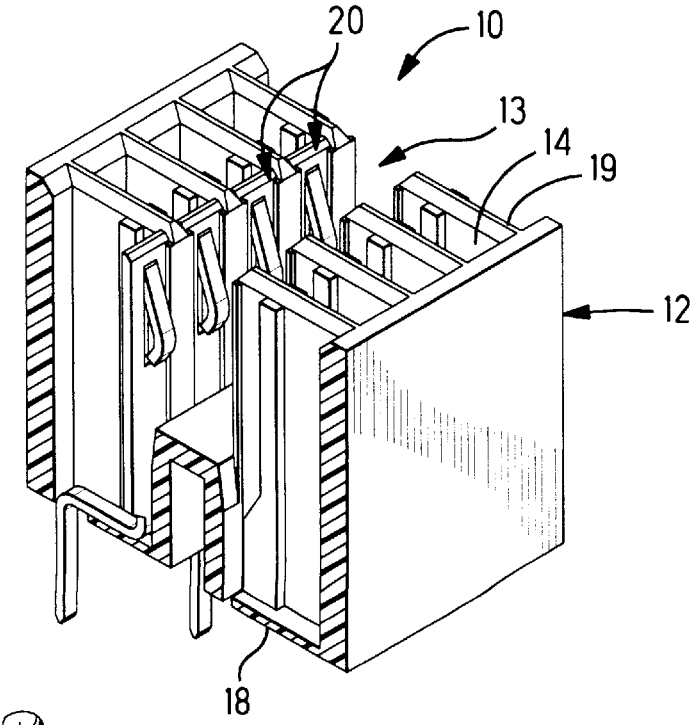
FIG. 2 shows a cut away three-dimensional view of the electrical connector according to the present invention.

Embodiments of the current invention will be first described generally with reference to FIG. 2. A connector 10 is shown here as having an insulative housing 12 which features a plurality of contact-receiving cavities 14 provided along a card-receiving slot 13. The contact-receiving cavities 14 extend from a board mounting end 18 to a mating end 19 and are open to the card-receiving slot 13. A series of contacts 20 are disposed each in a respective cavity 14. These contacts 20 extend from the card-receiving slot 13 through the board-mounting face 18 for connection to traces on a printed circuit board such as a mother board(not shown).

Figure 3:
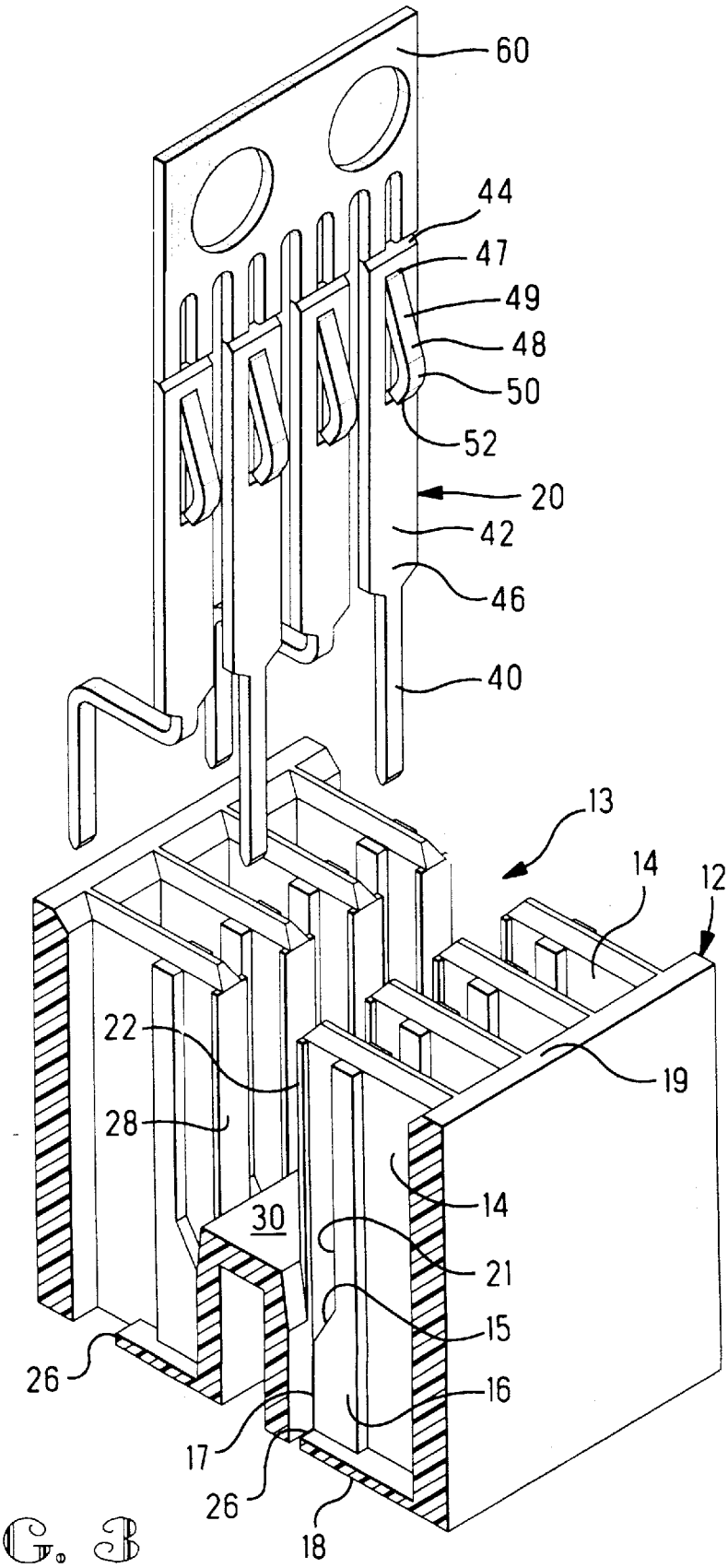
FIG. 3 shows a three-dimensional view similar to that of FIG. 2 having the contacts suspended above the housing prior to insertion.
Figure 4:
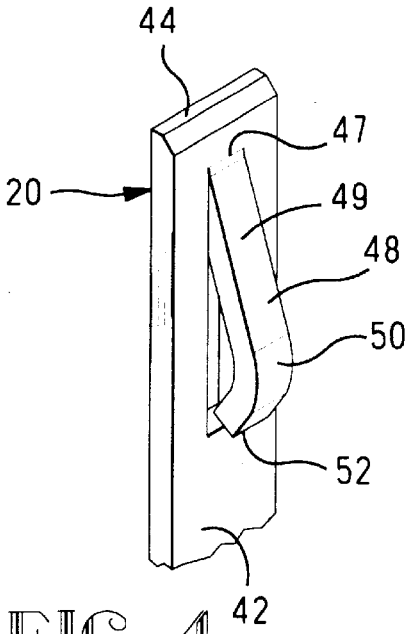
FIG. 4 shows a detailed 3-dimensional view of a portion of the contact of FIG. 3.

Each of the major components will now be described in greater detail with reference to FIGS. 3 and 4. Referring first to FIG. 3, the housing 12 of this embodiment will be described in greater detail. This housing 12 features a plurality of contact-receiving cavities 14 disposed along, and open to a card-receiving slot 13. The card-receiving slot 13 extends along substantially the entire length of the housing 12 and is defined by an opening along the mating face 19, sidewalls 28, and a bottom wall 30. Each cavity 14 extends from an opening 26 in the board mounting face 18 upward to a mating face 19 and is open on one side to the card-receiving slot 13.

Each cavity 14 contains a major projection 16 and a minor projection 22. The major projection 16 features a contact retention surface 17 proximate the board mounting face 18, a pivot surface 15 adjacent to the contact retention surface 17, and finally a contact overstress surface 21 extending from the pivot surface 15. The minor projection 22 is located along the sidewall 28 and extends into the cavity 14 at a location spaced apart from the contact overstress surface 21. The space provided between the contact overstress surface 21 and the minor projection 22 is designed to receive the free end 44 of the contact 20.

The contacts 20 of this embodiment will now be described in greater detail with reference to FIGS. 3 and 4. Each contact 20 is profiled to have a contact tail 40 for establishing electrical connection with a printed circuit board, a cantilever arm 42 extending from the tail 40 and a contact portion 48 being lanced from the cantilever arm 42 near a free end 44. The contact portion 48 is profiled to have a lead-in surface 49 near an attachment point 47. The lead-in surface 49 is bent from the cantilever arm 42 at the attachment point 47 such that it is positioned at a slight angle to the cantilever arm 42. A contact point 50 is formed in the contact section 48 and the free end 52 is bent from the contact point 50 back toward the cantilever arm 42. Finally, the cantilever arm 42 contains a retention section 46 near the transition to the contact tail 40.

Assembly of the major components will now be described in greater detail with reference again to FIG. 3. A series of contacts 20 are provided along a contact carrier 60 such that every other contact 20 along the carrier 60 has its tail 40 bent to be aligned with holes 26 which are located along outer edges of the mounting end 18. After bending of selected contact tails 40, the contacts 20 are mass inserted into the housing 12 from the mating end 19. The contacts 20 are forced into the cavities 14 such that they are retained at their retention sections 46 by the retaining surface 17 of the major projection 16. The contact carrier 60 is then broken away from the contacts 20 to result in the arrangement shown in FIG. 2.

Figure 5:
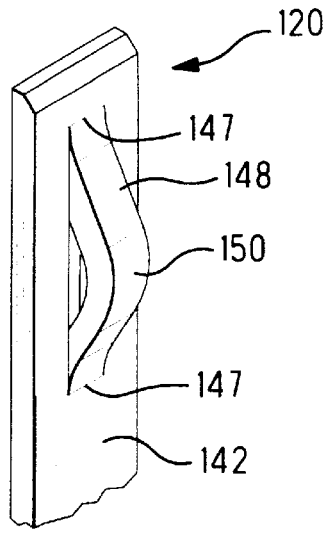
FIG. 5 shows a view similar to that of FIG. 4 for an alternate contact portion.

FIG. 5 shows a partial view of a first alternate embodiment for the contact 120 which can be utilized in such a connector as shown in FIG. 2. This contact 120 is similar to that shown in FIG. 4 except for a modification to the contact section 148. The contact section 148 is drawn from the cantilever arm 142 so that it is connected to the cantilever arm at two attachment points 147 instead of at one as shown in FIG. 4. The contact section 148 is formed by cutting a portion of the cantilever arm 142 and stretching or drawing the material to form a contact point 150 while maintaining attachment to the cantilever arm 142 at the two attachment points 147.

Figure 6:
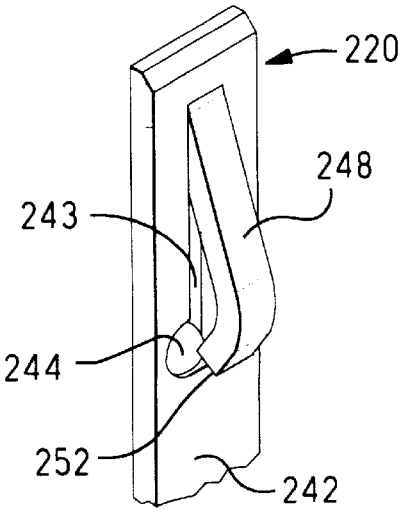
FIG. 6 shows a view similar to that of FIG. 4 for another alternate contact portion.

FIG. 6 shows yet another alternate embodiment for the contact design. This contact 220 features a similar cantilever arm 242 and a contact portion 248 similar to that of FIG. 4. The difference in this design is that the cantilever arm 242 is coined in the area of an opening 243 where the material was removed to form the contact portion 248. This coined area 244 prevents the free end 252 of the contact portion 248 from bending beyond the opening 243.

Figure 7:
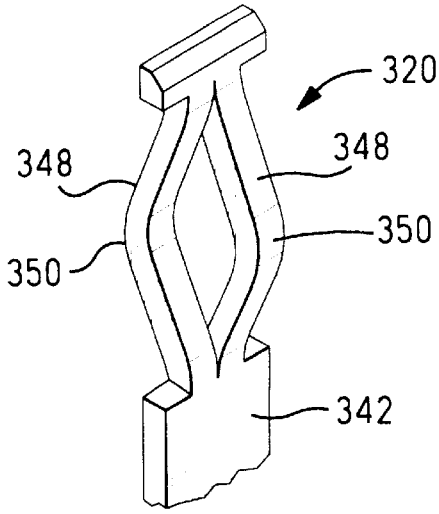
FIG. 7 shows a view similar to that of FIG. 4 for another alternate contact portion.

FIG. 7 shows yet another alternate embodiment for the contact design. This contact 320 features a similar cantilever arm 342 and first or second contact portions 348. Either one of the contact portions 348 may be inserted into the cavity 14 such that it faces the slot 13 for electrical connection to a pad on the card edge. Contact points 350 are formed along each contact portion 348. This design is similar to that of the alternate embodiment shown in FIG. 5 except that this contact 320 is insertable into the housing 12 in either direction in order to align the contact point 350 with a pad on the card edge.

Figure 8:
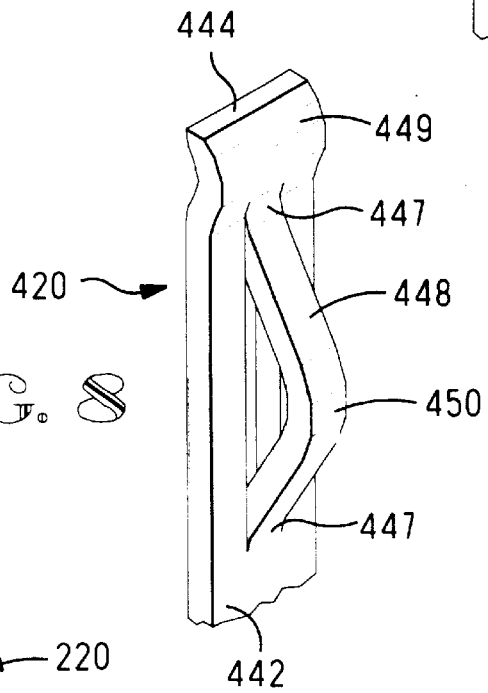
FIG. 8 shows a view similar to that of FIG. 4 for another alternate contact portion.

FIG. 8 shows a partial view of another alternate embodiment to the contact 420 which can be utilized in such a connector as shown in FIG. 2. This contact 420 is similar to that shown in FIG. 5 in that the contact section 448 having a contact point 450 is similarly drawn from the cantilever arm 442 so that it is connected to the cantilever arm at two attachment points 447. This contact 420 differs in that a preload projection 449 is formed in the cantilever arm 442 near the free end 444. The preload projection 449 is positioned to engage the minor projection 22 of the housing 12 to slightly urge the cantilever arm 442 away from the card receiving slot 13 to a preload position.

An advantage of these embodiments is that the contact point 50 is located at a minimum distance from the cantilever arm 42 so as to reduce the vertical component of the contact force exerted on the card edge upon mating. The horizontal component of the contact force is also maximized due to the positioning of the contact point 50 relative to the cantilever arm 42.

An additional advantage of the present invention is that because the cantilever arm 42 is a straight section, it can be force inserted from the mating end 19 and withstand insertion forces without buckling.

An additional advantage is that a lead-in surface 49 is provided along the contact portion 48 to prevent stubbing with the card edge.

While the foregoing has been provided with reference to the embodiments, various changes within the spirit of the invention will be apparent to those reasonably skilled in the art. For example, the coined section 244 shown in FIG. 6 could be located on the free end 252 of the contact portion to similarly prevent it from passing through the opening 243. Thus the invention should be considered as limited only by the scope of the claims.

We claim:

1. An electrical connector having a housing with a slot for receiving the edge of a printed circuit card, a series of contact cavities extending generally perpendicular to the slot, and a respective series of contacts disposed in the contact receiving cavities for establishing electrical connections to contact pads on the edge of the printed circuit card, the connector comprising:

the series of contacts being loadable into the housing from a mating end, the contacts having a main body extending from the mating end to a mounting end, and a tail extending from the main body through the mounting end, to a printed circuit board and being securable to the housing at the mounting end proximate the printed circuit board, a contact portion being lanced from the main body proximate the mating end thereby leaving an opening in the main body, the contact portion having a free end and an attached end connected to the main body at an attachment point, and a contact point spaced apart from the main body, the free end extending adjacent to the opening, the main body having a coined section extending into the opening to prevent deflection of the free end therethrough.

2. The electrical connector as recited in claim 1 wherein the contact cavities each comprise a major projection and a minor projection.

3. The electrical connector as recited in claim 2 wherein the major projection further includes a contact retention surface proximate the mounting end, a pivot surface adjacent the contact retention surface and an overstress surface extending from the pivot surface toward the mating end.

4. The electrical connector as recited in claim 2 wherein the minor projection is located at a distance from the major projection to define a contact free end receiving area.

5. The electrical connector as recited in claim 1 wherein the contact point is disposed along the contact portion at a distance from the attachment point.

6. The electrical connector as recited in claim 5 wherein the free end is bent from the contact point toward the main body.

7. The electrical connector as recited in claim 1 wherein the contact portion is attached to the main body at two attachment points.

8. The electrical connector as recited in claim 7 wherein the contact point is disposed on the contact section between the attachment points.

* * * * *